United States Patent [19]

Honda et al.

[11] 4,189,373

[45] Feb. 19, 1980

[54] PROCESS FOR THE PRODUCTION OF ASHLESS LIQUID FUELS

[75] Inventors: Hidemasa Honda; Yasuhiro Yamada; Hitoo Kakiyama, all of Tosu, Japan

[73] Assignee: Director-General of Agency of Industrial Science and Technology, Tokyo, Japan

[21] Appl. No.: 954,107

[22] Filed: Oct. 24, 1978

Related U.S. Application Data

[63] Continuation-in-part of Ser. No. 802,804, Jun. 2, 1977, abandoned, which is a continuation of Ser. No. 549,360, Feb. 12, 1975, abandoned.

[30] Foreign Application Priority Data

Feb. 14, 1974 [JP] Japan ..... 49-18376

[51] Int. Cl.[2] ..... C10G 1/04

[52] U.S. Cl. ..... 208/8 LE; 208/15

[58] Field of Search ..... 208/8 LE, 15

[56] References Cited

U.S. PATENT DOCUMENTS

| | | | |
|---|---|---|---|
| 3,375,188 | 3/1968 | Bloomer | 208/8 LE |
| 3,379,638 | 4/1968 | Bloomer et al. | 208/8 LE |
| 3,642,608 | 2/1972 | Roach et al. | 208/8 LE |
| 3,705,092 | 12/1972 | Gatsis | 208/8 LE |
| 3,849,287 | 11/1974 | Gleim et al. | 208/8 LE |
| 3,867,275 | 2/1975 | Gleim et al. | 208/8 LE |
| 3,870,621 | 3/1975 | Arnold et al. | 208/8 LE |
| 4,040,941 | 8/1977 | Yamada et al. | 208/8 LE |
| 4,052,291 | 10/1977 | Espenscheid et al. | 208/8 LE |
| 4,052,292 | 10/1977 | Espenscheid et al. | 208/8 LE |

*Primary Examiner*—Herbert Levine

*Attorney, Agent, or Firm*—William J. Daniel

[57] ABSTRACT

An ashless liquid fuel of good quality is produced by mixing powdery coal with a pitch having a C/H ratio of from 0.90 to 1.20 in an amount of at least 50 parts by weight per 100 parts by weight of the powdery coal, subjecting the mixture to a heat treatment conducted at from 400° to 450° C. and thereafter, removing a solid coagulated material formed in the treated product. The pitch having an atomic ratio C/H in the range from 0.90 to 1.20 is obtained by the heat treatment of a residual oil in the distillation of crude oils.

1 Claim, No Drawings

PROCESS FOR THE PRODUCTION OF ASHLESS LIQUID FUELS

BACKGROUND OF THE INVENTION

This is a continuation-in-part application of Ser. No. 802,804 filed June 2, 1977 which is a continuation of Ser. No. 549,360 filed Feb. 12, 1975 and both now abandoned.

This invention relates to a process for the production of ashless liquid fuels which comprises subjecting coal to a solvent treatment, especially to a solvent treatment using a pitch obtained from a residual oil as the solvent, to convert the ash contained in the coal into a coagulated material in an easily separable size and thereafter, removing the coagulated material.

Coal has been used as fuel for a very long period of time from the beginning of human history. With the incereasing production and consumption of petroleum in recent years, however, the position of coal as industrial and domestic energy source is being replaced by petroleum. Major reasons therefor are that coal is solid and is inconvenient in storage and transport as compared with liquid petroleum, that coal contains a large amount of ash and that coal is low in combustion efficiency. In order to improve these shortcomings of coal, various attempts have been made to liquefy coal. The methods for liquefying coal are roughly classified into a hydrogenolyzing method and a solvent treatment method, the former comprising the treatment of coal at a high temperature with highly pressurized hydrogen for producing light oils such as gasoline as the main product and the latter comprising the steps of mixing coal with a solvent and subjecting the mixture to a heat treatment conducted at from 300° to 400° C. thereby liquefying coal mainly to produce heavy oils. Illustrative of the solvents used in the latter method are heavy oils of coal series such as creosote oil, anthracene oil and coal tar (U.S. Pat. Nos. 3,375,188; 3,109,803 and 3,379,638).

On the other hand, much research has been carried out on effective utilization of heavy oils of petroleum series produced in large quantities as a by-product in the petroleum refining process with the recent increase in consumption of petroleum. An attempt was made for the utilization of heavy oils as a solvent for liquefaction of coal. As heavy oils of petroleum series are hardly miscible with those of coal series, however, no success has been reported hitherto in attempts to liquefy coal with a heavy oil of petroleum series as solvent. U.S. Pat. No. 3,705,092 discloses a method for liquefying coal wherein a solid bituminous coal is dispersed into a heavy oil of petroleum series and the dispersion is treated at a high temperature with high pressure hydrogen. The heavy oil of petroleum series used in this method merely functions as a dispersant for the bituminous coal but does not serve as a solvent therefor.

Liquid products obtained by the prior art methods for liquefaction of coal have been regarded improper, like the above-mentioned heavy oils of petroleum series, as fuel. This is because of the reason that the liquid products are contaminated with ash contained in the starting coal which forms scale on combustion and eventually lowers the combustion efficiency. Accordingly, the production of an ashless liquid fuel by liquefaction of coal is a key problem in the fields of the fuel industry.

SUMMARY OF THE INVENTION

It is an object of this invention to provide a method for liquefying coal to obtain a product which can be used as fuel.

It is another object of this invention to provide a process for the production of ashless liquid fuels from coal and residual oils produced in the distillation of crude oils.

The method of the present invention comprises the steps of (a) subjecting a residual oil, which is a by-product obtained from the distillation of crude oils, to a heat treatment at from 400° to 450° C. to form a pitch material having a C/H atomic ratio in the range from 0.90 to 1.20, (b) mixing the pitch material with powdered coal in a weight ratio of at least 50 parts of the pitch material per 100 parts of the coal, (c) heating the mixture of the pitch material and the coal at from 400° to 450° C. to effect substantial dissolution of the coal in the pitch material whereby the ash content in the coal coagulates together with the insoluble optically anisotropic microspherules produced in the pitch material as the nuclei, and (d) removing the thus coagulated material from the mixture.

DETAILED DESCRIPTION OF THE PREFERRED EMBODIMENTS

It has now been found that, when residual oils in the distillation of crude oils are thermally treated at a temperature above 400° C., the amount of aromatic components gradually becomes larger which flocculate to form optically anisotropic microspherules having a size of about 3 $\mu$m or less along with the formation of a pitch material, that, when coal is allowed to be present during such thermal treatment, the coal easily tends to dissolve in the residual oil or the pitch material by virtue of the aromatic components, that the use of a pitch material having an atomic ratio C/H of from 0.90 to 1.20 enhances the dissolving effect of coal, and that ash contained in the starting coal is readily removed as coagulated with the microspherules produced in the pitch material.

According to the process of the present invention, therefore, a liquid fuel absolutely or substantially free from ash can be obtained by mixing powdery coal with a pitch material in an mount of at least 50 parts by weight per 100 parts by weight of the coal, heating the mixture at from 400° to 450° C. under atmospheric or superatmospheric pressure to effect substantial dissolution of the coal in the pitch material, allowing the ash content in the coal to coagulate fully with the microspherules produced in the pitch material and thereafter removing the insoluble coagulated material by centrifugal separation or filtration.

When the viscosity of the mixture obtained by heating the mixture of coal powder and the pitch material is so high that it is difficult to effect centrifugal separation or filtration, the mixture may be diluted with an organic solvent, an oil of coal series or an oil of petroleum series.

One of the starting materials used in the inventive process is coal exemplified by bituminous coal and brown coal. The coal is used in the form of finely divided powder with a particle size distribution of, preferably, 0.4 mm or finer.

The other of the starting materials in the inventive process is a residual oil which is obtained as a by-product from the distillation, either under atmospheric pressure or under a reduced pressure, of crude oils in the petroleum refining process. The C/H atomic ratio in such a residual oil is usually in the range from 0.57 to 0.75. It is well known that the C/H atomic ratio of such a residual oil gradually increases when the residual oil is subjected to heat treatment at a temperature of, say 400° C. or higher with gradual increase in the content of aromatic matter and formation of a pitch material.

As is established by the inventors, any coal powder can be dissolved in such a residual oil when it is heated as intermixed with the residual oil at a temperature of 400° C. or higher. Therefore the investigation of the inventors was directed to the solubilization of coal in the residual oil with the object to obtain an ashless liquid fuel from coal and the residual oil and it was unexpectedly found that satisfactory dissolution of coal can be obtained when the coal powder is heated as admixed with a pitch material having a C/H atomic ratio in the range from 0.90 to 1.20 at a temperature of 400° to 450° C. and that, in addition, the ash content in the coal can be readily removed as coagulated from the mixture.

To describe the inventive process in further detail, the residual oil is first subjected to heat treatment at a temperature in the range from 400° to 450° C. Thereupon, as is stated earlier, thermal decomposition of the residual oil takes place and the lighter fraction thus produced is distilled off leaving the heavier fraction which is rich in aromaticity and eventually becomes a pitch material having a C/H atomic ratio higher than 0.90. When the heat treatment is further carried out, the C/H atomic ratio of the pitch material gradually increases with the incipient formation of insoluble optically anisotropic microspherules, which can be determined as a quinoline-insoluble matter.

It is a requirement in the invention that the C/H atomic ratio to be used in the subsequent step of the process is in the range from 0.90 to 1.20 because a pitch material with a C/H atomic ratio outside this range is inferior in the solubilizing power of coal or in the coagulation of the ash content in the coal. To explain it, the microspherules as being produced in the pitch material functions as nuclei for the coagulation of the ash content and the microspherules ready-formed in the pitch material before mixing with the coal powder are ineffective as the coagulation nuclei. In this regard, the amount of the microspherules in the pitch material to be mixed with the coal powder is preferably less than a few percent in order to give satisfactory coagulation of the ash content.

The time required for this step (a) of the heat treatment of the residual oil depends largely on the temperature and the origin of the residual oil but it takes usually about 15 minutes to 4 hours.

The pitch material thus prepared is then mixed with the coal powder. The mixing ratio of the pitch material and the coal powder is preferably such that at least 50 parts by weight of the pitch material is mixed with 100 parts by weight of the coal powder. When the amount of the pitch material is smaller than above, the resultant mixture is hardly stirred by a usual stirring means and considerably large fraction of the coal will remain undissolved in the pitch material along with the difficulty in the separation of the ash coagulation by centrifugal separation or filtration. On the other hand, larger amounts of the pitch material do not suffer from the drawbacks as above but the yield of the objective liquid fuel becomes smaller leading to an economical disadvantage.

The mixture of the pitch material and the coal powder is then subjected to heat treatment at a temperature in the range from 400° to 450° C. This temperature range is critical because the dissolution of the coal in the pitch material is incomplete or takes an excessively long time at lower temperatures leading to lower yield of the objective liquid fuel with disadvantageously low productivity while higher temperatures than above accelerate the coke-formation in the pitch material also leading to lower yields of the objective liquid fuel.

The heat treatment of the mixture of the pitch material and the coal powder may be carried out either under atmospheric pressure or under superatmospheric pressure in a closed vessel. When the heating is carried out under atmospheric pressure, the lighter fraction of the decomposition products of the pitch material is distilled off. The heat treatment in a closed vessel is advantageous because the lighter fraction of the decomposition product of the pitch material does not leave the mixture contributing to the reduction of the viscosity of the mixture facilitating subsequent removal of the insoluble matter from the mixture.

In the course of the heat treatment of the mixture of the pitch material and the coal powder with stirring, the particles of coal become softened and disintegrated to be dissolved in the pitch material leaving the ash content undissolved. On the other side, the pitch material undergoes further decomposition with increasing C/H atomic ratio. As is mentioned before, the in situ formation of the microspherules in the pitch material is very advantageous in their function as the coagulation nuclei of the ash content in the coal. This is the largest advantage of the inventive process because the removal of the ash content in the coal, which has been considered very difficult in the prior art, can be readily performed to give substantially ashless liquid fuel products.

The size of the aggregates formed by the coagulation of the ash content in the coal with the microspherules as the nuclei depends on the conditions of the heat treatment. When the heat treatment is performed at a relatively high temperature or for a prolonged time of period, the aggregates grow in size but the size rarely exceeds 5 μm by the influence of the ash content in the coal. However, a size of at least 1 μm is sufficient for the removal by conventional separation techniques such as centrifugal separation or filtration.

It is of course optional that, when the viscosity of the mixture having been subjected to the heat treatment for the dissolution of the coal powder is too high for the conventional separation means, an organic solvent is added to reduce the viscosity of the mixture to facilitate the removal of the ash aggregates. The solvents suitable for the purpose include quinoline, pyridine and nitrobenzene as a good solvent for the bituminous materials; a petroleum series oil with relatively high aromaticity; and oils of coal origin such as anthracene oil, creosote oil and pitch oil. It is also recommendable that the separation of the ash aggregates is performed at an elevated temperature so as that the viscosity of the mixture is reduced. With the method as described above, it is a rather easy practice to remove more than 90% of the ash content from the mixture to give substantially ashless liquid fuel as the product.

When an organic solvent has been used to reduce the viscosity of the mixture, it may be subsequently recovered by a suitable means from the mixture, if necessary. The mixture after removal of the ash aggregates is optionally diluted with a suitable petroleum oil in order to impart physical properties required in a liquid fuel according to need.

The process of the present invention is so advantageous that no troublesome operations nor impractical conditions are necessitated together with the simplicity of the process apparatuses. The most advantageous characteristic of the present process is the easiness and the completeness of the removal of the ash content in the coal to an extent never achieved in the prior art methods.

The process of the present invention is now illustrated in further detail by way of examples and controls.

EXAMPLE 1

A residual oil with a C/H atomic ratio of 0.7 obtained from the distillation of Kafji crude oil under reduced pressure was subjected to a heat treatment at 420° C. for 60 minutes in a stream of nitrogen under atmospheric pressure. The thermally cracked oil fraction distilled out and collected by cooling weighing 43.6% by weight of the starting residual oil leaving a pitch material corresponding to 50.3% by weight of the residual oil, the loss by gasefication being 6.1% by weight. The pitch material had a C/H atomic ratio of 1.00 and contained 3.1% by weight of a quinoline-insoluble fraction.

A mixture prepared by blending 100 parts by weight of pulverized Miike coal with an average particle diameter of 0.3 mm and an ash content of 7.1% by weight and 100 parts by weight of the above obtained pitch material at 250° C. was further heated under agitation at a rate of temperature elevation of 3° C. per minute up to 400° C. where agitation was continued for 60 minutes.

During the above heat treatment, 1.0% by weight of a cracked oil fraction distilled out and the remaining mixture weighed 96.3% by weight of the initial amount of the mixture. The quinoline-insoluble matter in this heat-treated mixture was 10.3% by weight and examination of this mixture with a polarization microscope showed almost complete dissolution of the coal particles with no coal particles not disintegrated.

The quinoline-soluble fraction of the mixture was subjected to distillation under reduced pressure to remove quinoline. The ash content of the thus obtained product was 0.05% by weight. The product was then admixed with 100 parts by weight of creosote oil and heated at 100° C. to achieve uniform mixing whereby the mixture became something like a heavy oil which was fluid at room temperature. This product had a calorific value of 9,800 calories/g and was suitable as a liquid fuel.

EXAMPLE 2

A residual oil obtained in the distillation of Kafji crude oil under reduced pressure was subjected to a heat treatment at 410° C. for 60 minutes in a stream of nitrogen under atmospheric pressure. The thermally cracked oil fraction distilled out and collected by cooling weighing 31.8% by weight of the starting residual oil leaving a pitch material corresponding to 58.0% by weight of the residual oil, the loss by gasefication being 10.2% by weight. The pitch material had a C/H atomic ratio of 0.91.

The thus obtained pitch material was mixed with equal amount of pulverized Taiheiyo coal, which is a brown coal with a chemical assay of C 74.5% and H 6.2% and the mixture was subjected to a heat treatment at 440° C. for 15 minutes, during which 15.3% by weight of gaseous products escaped and 22.7% by weight of cracked oil fraction distilled out and collected leaving 62.0% of solubilized pitch-like material, which was treated with quinoline in the same manner as in Example 1. The quinoline insoluble matter in this pitch material was 31% by weight and the ash content in the quinoline soluble fraction was 0.07%. The quinoline soluble fraction of the pitch material diluted with creosote oil was found to be suitable as a liquid fuel.

EXAMPLE 3

A residual oil from an Arabian Light crude oil with a C/H atomic ratio of 0.68 was subjected to a heat treatment at 430° C. for 60 minutes in the same manner as in the preceding Examples to give 51.4% by weight of a pitch material with a C/H atomic ratio of 1.16, the amount of the cracked oil fraction and loss by gasification being 40.0% and 8.6%, respectively.

The thus obtained pitch material was mixed with equal amount of the same pulverized coal as used in Example 1 and the mixture was subjected to a heat treatment at 420° C. for 60 minutes giving a solubilized pitch-like material, the yield of which being 88% with 6.7% of cracked oil fractions and 5.3% of a loss by gasification. It was found by quinoline treatment in the same manner as in the preceding Examples that the quinoline insoluble matter in this pitch material was 31% and the ash content in the quinoline soluble fraction was 0.11%.

COMPARATIVE EXAMPLE 1

A mixture prepared by blending 100 parts by weight of pulverized Miike coal with an ash content of 6.2% by weight and 200 parts by weight of the same residual oil as used in Example 1 was subjected to a heat treatment at 430° C. for 60 minutes under atmospheric pressure with agitation. The fraction of the thermally cracked oil distilled out and collected weighing 43.2% by weight of the starting mixture leaving a solubilized pitch-like material weighing 56.3% by weight of the starting mixture, the balance being the loss by gasification.

The pitch-like material was admixed with 3 times by weight of quinoline to be dispersed therein and subjected to centrifugal separation to find that the content of the quinoline-insoluble matter was 21.0% by weight based on the amount of the pitch-like material. The ash content of the quinoline-soluble fraction after removal of quinoline by distillation under reduced pressure was 0.18% by weight.

COMPARATIVE EXAMPLE 2

The same residual oil as used in Example 1 was subjected to a heat treatment at 440° C. for 60 minutes under atmospheric pressure. During the heat treatment, the fraction of the thermally cracked oil distilled out leaving a pitch material in an amount of 38% by weight of the starting residual oil. The pitch material had a C/H atomic ratio of 1.25 and the content of the quinoline-insoluble matter in this pitch material was 28% by weight.

A mixture prepared by blending 100 parts by weight of the above pitch material with 100 parts by weight of the same pulverized Miike coal as used in Example 1 was subjected to a heat treatment with the same schedule as in Example 1. By this heat treatment, 3.5% by weight of the fraction of thermally cracked oil distilled out leaving 93% by weight of the heat-treated mixture which contained 42% of quinoline-insoluble matter upon dilution with 3 times by weight of quinoline. The microscopic examination of the heat-treated mixture indicated that considerable amount of the coal particles remained undissolved.

After removal of the quinoline-insoluble matter by filtration and removal of quinoline by distillation under reduced pressure, the resultant product was analyzed for the ash content which was found as high as 0.16% by weight.

COMPARATIVE EXAMPLE 3

The same pitch material obtained from the residual oil as in Example 2 was mixed with equal amount of the same pulverized Miike coal as in Example 1 and the mixture was subjected to a heat treatment at 470° C. for 15 minutes. The yield of the solubilized pitch material was 58.0% with 32.5% of the cracked oil fractions and 9.5% of a loss by gasefication.

The quinoline-insoluble matter in the above solubilized pitch-like material was as high as 58.4% indicating the remarkable decrease in the yield of the quinoline soluble fraction even though the ash content in the quinoline soluble fraction was 0.08% at a sufficiently low level as a liquid fuel.

What is claimed is:

1. A process for producing an ashless liquid fuel from coal and a residual oil having an atomic ratio of C/H in the range from 0.57 to 0.75 obtained from the distillation of crude oils which comprises the steps of (a) subjecting the residual oil to a heat treatment at a temperature in the range from 400° to 450° C. to form a pitch material having an atomic ratio of C/H in the range from 0.90 to 1.20, (b) mixing the pitch material with finely divided coal powder in a weight ratio of at least 50 parts of the pitch material per 100 parts of the coal powder, (c) subjecting the mixture of the pitch material and the coal powder to a heat treatment at a temperature in the range from 400° to 450° C. to effect substantial dissolution of the coal in the pitch material whereby the ash contained in the coal coagulates together with the insoluble optically anisotropic microspherules produced in the pitch material, and (d) removing the thus coagulated material from the mixture.

* * * * *